US006022008A

United States Patent [19]

Bachman

[11] Patent Number: 6,022,008

[45] Date of Patent: Feb. 8, 2000

[54] DOOR HANGING JACK

[76] Inventor: David Bachman, 109 S. 3rd St., Coplay, Pa. 18037

[21] Appl. No.: 09/022,131

[22] Filed: Feb. 11, 1998

[51] Int. Cl.[7] ..... B25B 1/20

[52] U.S. Cl. ..... 269/37; 254/131

[58] Field of Search ..... 269/37, 133, DIG. 905, 269/60; 254/126, 131, DIG. 1, DIG. 3; 16/82

[56] References Cited

U.S. PATENT DOCUMENTS

| | | | |
|---|---|---|---|
| 604,833 | 5/1898 | Muller . | |
| 671,554 | 4/1901 | Heisler . | |
| 1,681,834 | 8/1928 | Arends . | |
| 1,833,005 | 11/1931 | Staggers . | |
| 2,682,076 | 6/1954 | Christensen . | |
| 3,642,251 | 2/1972 | Niederholtmeyer . | |
| 3,871,054 | 3/1975 | Schaefer . | |
| 4,043,536 | 8/1977 | Almond . | |
| 4,712,771 | 12/1987 | Donelly et al. . | |
| 5,294,099 | 3/1994 | Dalfino | 269/133 |
| 5,814,842 | 9/1998 | Muldoon et al. | 254/131 |

FOREIGN PATENT DOCUMENTS

| | | | |
|---|---|---|---|
| 24324 | 11/1902 | United Kingdom | 269/60 |
| 999839 | 7/1964 | United Kingdom . | |
| 2225769 | 7/1988 | United Kingdom | 254/131 |
| 2225769 | 6/1990 | United Kingdom . | |

*Primary Examiner*—Eileen P. Morgan
*Assistant Examiner*—Daniel Shanley
*Attorney, Agent, or Firm*—Charles A. Wilkinson

[57] ABSTRACT

A door-hanging jack for adjustably supporting doors in door openings while installing doors in building structures. The jack structure has a generally triangular base with a pivoted rectangular framework secured to the top and has a structural angle shaped door-supporting member on one side overlying one edge of the triangular base. A threaded member at an apex of the triangle provides movement of the door supporting member through the interaction of a female threaded member having foot engageable handles.

15 Claims, 9 Drawing Sheets

35a
35b
31a
31b
29
23
23b
25
25a
27
23a
26a
23c
17
26b
15a
13b
39
21
19
13
15b
13a
39

DOOR HANGING JACK

BACKGROUND OF THE INVENTION

1. Field of the Invention

This invention relates to so-called jacks and lifting devices by which heavy or awkward objects may be raised from a primary supporting surface during repair or construction. More particularly, the invention relates to an effective jack or lifting device for lifting doors into position during so-called "hanging" of such doors, particularly in new construction, but also in existing construction.

2. Prior Art

When mounting swing-type doors in a building, the door must not only be very accurately made to fit the door frame, but also must be accurately held in place in the door frame both while the hinges and sometimes locks are being affixed to the door and the frame, but also in most cases, while the hinge and lock position is being measured or laid out prior to actual affixation of the hinges and lock on the door. Customarily, the door is first carried to the door opening into which it is to be inserted and is manually raised into position and held temporarily in place by means of shims or small wedges of wood or the like while being measured or while being mounted or attached to the door frame. Sometimes nails have been driven into the floor under where the door is to be mounted at both sides of a door frame with their heads at the calculated height of the bottom of the door to support such door while being mounted in place. Both shims and nails in the floor tend to damage the floor, however, particularly in the case of supporting nails. The hanging operation has traditionally been a two-man operation in which a carpenter or other skilled workman marks the door and shims it into exact position while a carpenter's helper holds the door in place or actually shims it into place by forcing slanted shims under it until the carpenter indicates such door is in exact position. Accurate fitting and hanging of a door is skilled labor, the successful completion of which has a large effect upon the quality of a building as well as the perception of the quality of a building.

While the trend has been to the use of lighter doors and particularly hollow or foam plastic insulated metal doors and the like for residential construction, at the same time in industrial and commercial establishments there has been a noticeable trend to heavier doors, some of which may weigh hundreds of pounds or even more. In such installations the difficulty in hanging the door is often multiplied by a factor of two or more up to as much as ten or more. Even very light doors, however, present a serious problem with respect to holding in place during installation, because a single workman has at most only two arms and hands to both hold a door in place and work on it at the same time during installation.

So-called door jacks for lifting into position a door during hanging of such door have been invented or developed before, but none, so far as the present inventor is aware, have come into widespread use. Some of such jacks have been provided with wheels or other sliding arrangements so that a door may not only be raised into proper position in the door frame, but also may be basically rolled or slid horizontally into position by a single worker. Typical of some of the prior art devices are those shown and described in the following patent documents.

U.S. Pat. No. 604,833 issued May 31, 1898 to R. Muller discloses a lever-type lifting device mounted upon a roller-like bottom block and having a downwardly curved door support on one end for slipping under a door. The lever may also be mounted upon a separate lower mounting or shore piece to apparently provide stability of the lever during use. The device is designed for partial unhinging of a door to more effectively oil or lubricate the hinges of such door.

U.S. Pat. No. 671,554 issued Apr. 9, 1901 discloses a door or window lifter comprising a base having a curvilinear lever pivoted between two pivot arms extending upwardly from the base. A lever catch arrangement is provided at the rear of the device to fix the lever in an upwardly biased position to hold a door or window in a single elevated position.

U.S. Pat. No. 1,681,834 issued Aug. 21, 1928 to A. A. Arends discloses a door-holding or lifting tool comprised of a sort of sliding crowbar arrangement with preferably a tooth end and a fulcrum block, preferably having a rubber fulcrum on the bottom and two pivoted brace bars on the top which aid in holding the door in place while supported on the upturned end of the lowered crowbar section.

U.S. Pat. No. 1,833,005 issued Nov. 24, 1931 to W. F. Staggers discloses a door-holding device comprised essentially of a flat holding or supporting bar having upstanding teeth on the top surface for engaging a door, plus a set of wheels at one end pivoted upon a base with a handle which may be pivoted to a position in which the tooth carrier bar lies flat upon the floor and a series of positions in which it is pivoted upwardly at one end to raise the door into various vertical positions or elevations from the floor. The door is supported crosswise to the longitudinal length of the supporting bar upon which it rests.

U.S. Pat. No. 2,682,076 issued Jun. 29, 1954 to S. O. Christensen discloses a mechanical apparatus for both elevating and shifting a boxcar door laterally or horizontally by means of a device including a roller and a pivotable handle that exerts leverage to raise the door so it can then be slid sidewise on its normal track. The device is not constructed for temporary support of a door while working on it, but for use in first raising a boxcar door from its closed and locked position into the raised position in which it may move along the door track supplied for opening of such door.

U.S. Pat. No. 3,871,054 issued Mar. 18, 1975 to T. S. Schaefer discloses a U-shaped, two-wheel, door-transporting dolly which can be used to lift the door into place by canting the frame of the dolly with the foot.

U.S. Pat. No. 3,642,251 issued Feb. 15, 1972 to F. J. G. Niederholtmeyer discloses a crowbar-type door lifter or adjuster having a side rest bar at the top of the crowbar section to stabilize the upright position of the door while canting the crowbar to lift the door.

U.S. Pat. No. 4,043,536 issued Aug. 23, 1977 to L. T. Almond discloses a wheeled dolly for transporting doors having a handle for wheeling the door into place and a foot incline or lanyard for depressing the handle to lift a carrying ledge on the dolly to lift, or elevate, and support the door in place.

U.S. Pat. No. 4,712,771 issued Dec. 15, 1987 to K. S. Donnelly discloses a rectangular pivoted-type wallboard jack in which the wallboard rests on a thin lip at the edge of the pivoted section of the jack and is lifted by depressing the opposite end of the jack.

British Specification 999,839 dated Jul. 8, 1964 to Scaffolding Limited discloses a lifting and transporting jack comprising a wheeled dolly with a handle between the wheels and having a lifting lip in the front.

British Specification 2,225,679 dated Jun. 13, 1990 to W. R. Kashey discloses a flat base with a pivoted lever arm pivotally supported on top having said lever arm having a forward ledge for support and adjustment of a door or window. The height of such door or window in the frame is controlled by an inclinable screw-threaded biasing member having a handle on top. The threaded adjustment includes a threaded female fitting that threads onto an inclinable male threaded member and exerts downward force upon one end of the pivotable member.

While the available prior art devices, as summarized by the above-described patent documents, have been effective to a point, they have not been as efficient as could be hoped. There is a clear need, therefore, for an improved practical apparatus for accurately supporting doors, including relatively massive doors and the like, while hanging such doors, which device can be easily and effectively used by a single workman, eliminating the usual necessity to have at least two and possibly more workmen hanging such doors.

OBJECTS OF THE INVENTION

It is an object of the invention, therefore, to provide a door-hanging jack which is sturdy enough and stable enough to hold the door absolutely level and parallel to the floor while hanging such door, which jack apparatus can be easily adjusted.

It is a further object of the invention to provide a sturdy door jack which can be adjusted by use of the feet of the workman hanging the door in two or more different speed modes.

It is a still further object of the invention to provide a door-hanging jack which can be adjusted easily by a single workman.

It is a still further object of the invention to provide a door-hanging jack which, while sturdy and stable, has a low or minimum weight so that it may be easily carried from job to job.

It is a still further object of the invention to provide a door-hanging jack having an adjustable arrangement for adjustment of the jack with the feet.

It is a still further object of the invention to provide a door-hanging jack having a triangular base section which is both stable and of minimum weight.

It is a still further object of the invention to provide a door jack with a wide door support section provided with an aligning edge to assure parallel placement of the door.

It is a still further object of the invention to provide a door jack constructed for ready substitution of screw members or jacking screws, to facilitate changes in jacking speed.

It is a still further object of the invention to provide a door jack with a variety of jacking handles and jacking screws for ready conversion of such door jack to the speed and accuracy of jacking desired by the carpenter or other door installer.

Other objects and advantages of the invention will become evident from review of the appended drawings together with the following description and explanation.

BRIEF DESCRIPTION OF THE INVENTION

The door-hanging apparatus of the invention is comprised of a triangular or equivalently shaped base supporting a sturdy pivotable support framework having an extended door-support ledge with a continuous support member along one side, and incorporating a male threaded member rigidly mounted upon the base plate and provided with a rotatable handle having at least two upward extensions incorporating ends that can be easily engaged with one foot of the user to turn a threaded female member upon the screw threaded male member to vertically adjust the position of a door being hung by opposing the force or weight of a door supported upon the door support ledge on the other end. The door support ledge is preferably supplied with a door aligning guide along one side. The jack may be supplied with additional threaded members to further facilitate interchangeability or inter-convertability of operational movement and particularly speed of operation of the jack apparatus.

DESCRIPTION OF THE PREFERRED EMBODIMENTS

Figure 1:
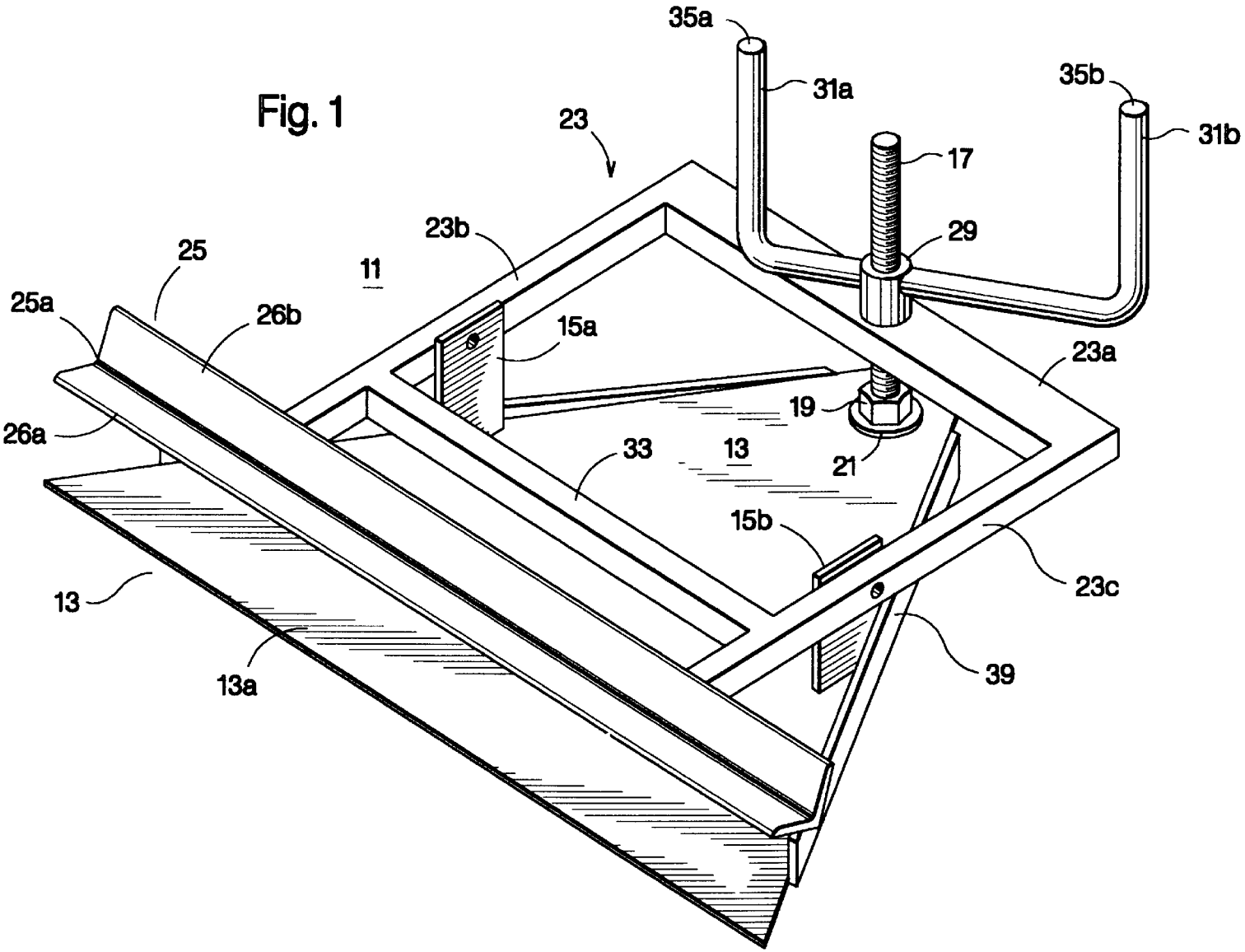
FIG. 1 is an isometric view of a door-hanging apparatus in accordance with the invention.

While, as was indicated in the discussion of the prior art above, there have been previous disclosures of and uses of door-hanging jacks, such prior devices have not proved to be as efficient or effective as desirable. Consequently, the present inventor has developed an improved door-hanging jack which is effective to easily and simply allow a single workman to position and hang doors both without undue effort and in a minimum of time. The present inventor has found that there are several critical things which should be taken into account in the development of an effective door-hanging jack. The first of these is that the support of the door should be sufficiently wide or extensive so that there is no likelihood that the door will tip such that it is not parallel to the floor when it is installed. The second of these requirements is that the door hanger jack be strong and sturdy, not only so that it can take the inevitable abuse and wear incident to being taken from one work place to another, but also so that it will effectively hold a heavy door without tipping, warping, springing or the like. The third of these requirements is that the door hanger be as light as possible so that it may in fact be easily transported from one job to another. A fourth requirement is that the device should be easily and effectively used by a single person. In order to assure that only a single person or workman need be involved in hanging the door it is desirable that the door-hanging jack may be operated not only by the hands of the workman, but also by the feet.

In the hanging of doors, the hanger workman is almost in the position of the proverbial one-arm paper hanger, in that he or she requires to have two hands to work on the door, plus a third hand to adjust the position of the door. By making the device of the invention operable by foot movement, the workman is in effect, provided with an extra working limb. In order to be foot operable, however, the device should have certain characteristics that adapt the adjustment mechanism to easy operation by the feet. During his development, the present inventor also found that it is desirable for the adjustment of the door-hanging jack to be variable, i.e. it is desirable that the position of the door may be adjustable either quickly with possibly diminished accuracy or that it be adjustable more slowly with increased accuracy. The inventor has found that this may be accomplished by providing two displaced handles which are arranged for actuation by the feet of the user. In addition, it is desirable for the adjustment means to be relatively rigidly attached to the lift apparatus so that it can be operated by mere contact with the workman's foot rather than requiring grasping by the hands. Perfection of these desirable attributes of a door-hanging jack has enabled the present inventor to develop a door-hanging jack having the following characteristics and attributes:

(a) The jack is made from sturdy metal sections.

(b) The base of the jack is made in a triangular configuration or a configuration which may be referred to as semi-triangular to provide stability of the jack with minimum weight.

(c) The door-supporting section is aligned along one of the edges of the triangle, which preferably takes the form of an equilateral triangle, to obtain maximum support and stability with reference to the door itself.

(d) A sturdy supporting framework for the door-supporting section is pivoted upon the triangular base.

(e) The supporting framework is preferably generally rectangular or semi-rectangular to provide maximum lateral stability upon the triangular base.

(f) A screw section is rigidly, but removably, mounted at an apex of the triangle to add to the stability of the jack during movement or adjustment of the door.

(g) The pivot points of the supporting framework are mounted about two-thirds of the way down the sides of the triangular base at a position such that there is maximum space between the two pivot points while at the same time providing sufficient differential leverage between the attachment of the door-supporting section to the pivotable framework and the position of the screw member which serves to move the framework.

(h) The bottom of the base should either be roughened or provided with gripping surfaces or members associated with it to discourage slippage on a floor while hanging a door, but should not be so sharp as to damage the underlying floor.

(i) The door supporting sections should incorporate an extended lifting or support surface bounded on one side by an effective side support or rest that will automatically align the door straight or rectangularly oriented along the support.

In accordance with the above design and construction considerations, the present applicant has provided an effective and efficient door-hanging jack as shown in the attached drawings.

With the above in mind, the following detailed description of the invention is of the best presently contemplated mode of carrying out such invention. This description is not intended to be understood in a limiting sense, but is made solely for the purpose of illustrating the broad general principles of the invention. Therefore, various features and advantages of the instant invention may be more readily understood with reference to the following detailed description taken in conjunction with the accompanying drawings, but should not be thought to constitute the only mode or manner of carrying out the invention which is to be restricted only by the terms of the accompanying claims.

Referring now to the drawings as shown in detail, where like numerals refer to like parts or elements, there is shown in FIG. 1, which is an isometric view of a door-hanging jack in accordance with the invention, an overall view of such jack which is designated overall by the reference numeral 11. Such jack is comprised of a triangular base 13 formed from a heavy plate material such as, for example, one-eighth or one-sixteenth inch plate or the like having two pivot supports 15*a* and 15*b* secured to the upper surface about two-thirds of the way down both sides from an apex 13*b* of the triangular 13 base. A removable threaded rod or stud member 17, which may take the form of a threaded bolt having a rectangular head is mounted near the rear apex 13*b* of the base 13 by passage through a hole or orifice in the base, which hole or orifice preferably has a shape which cooperates with or closely conforms to the shape of the under section of the bolt. Preferably the bolt will thus comprise a threaded shank having a round or other shaped head with the underside of the head next to the shank having a rectangular or other configuration conforming with the inner configuration of an orifice in or adjacent to the apex of the triangular base. Such threaded bolt or rod 17 is preferably provided with a threaded nut or fastening 19 which is screwed all the way down against the top of the base plate to secure the threaded rod or bolt 17 rigidly in the base. Such nut 19 preferably is underlaid by washer 21 which better distributes the force of the nut 19 across the surface of the base and aids in drawing the inside of the head of the bolt tightly into the rectangular opening, not shown, in the base plate 13 further stabilizing the threaded rod or shank of the bolt 17.

Figure 5:
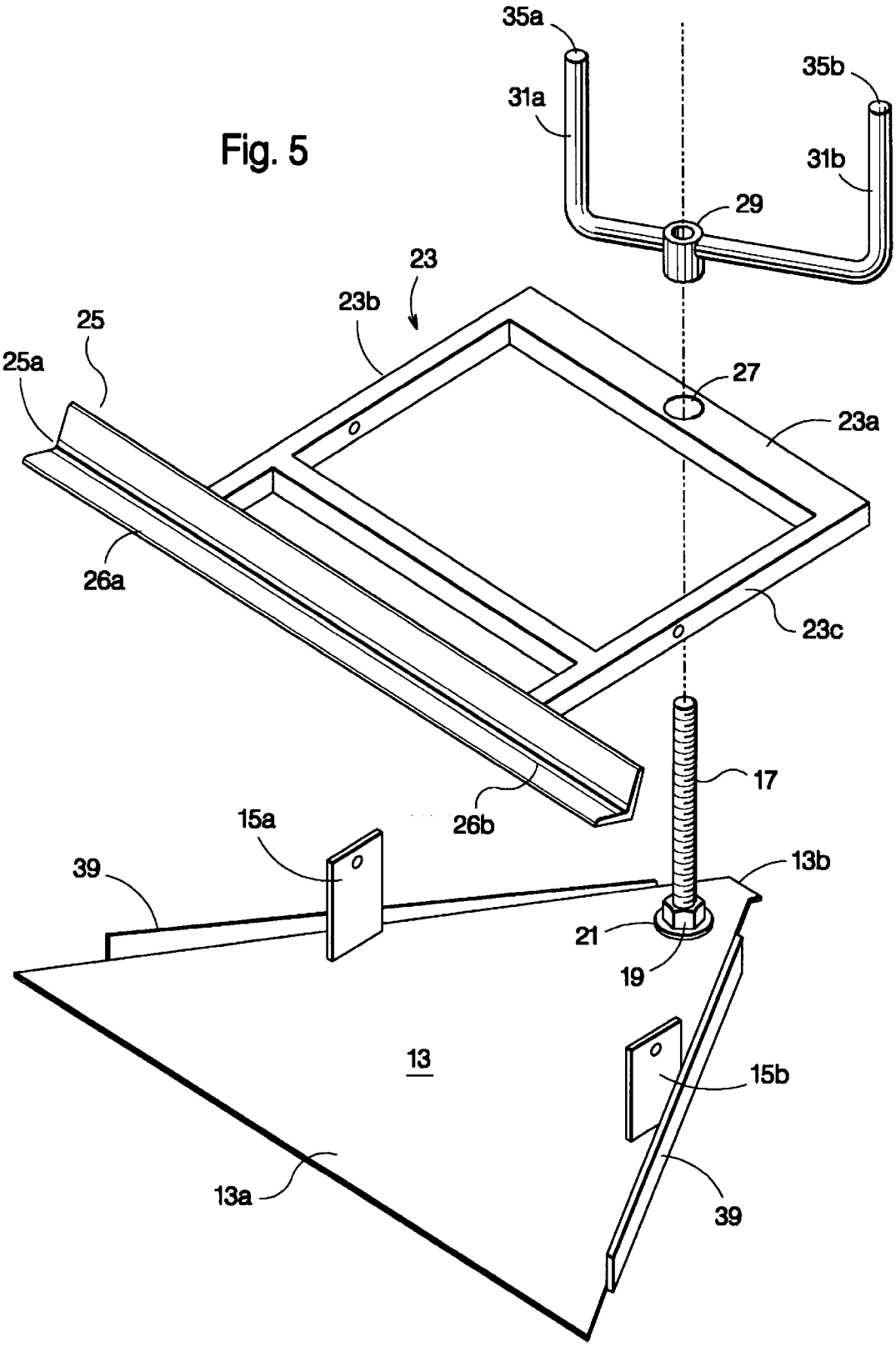
FIG. 5 is an assembly view of the door hanging apparatus of the invention.

A preferably rectangular support framework 23 is pivotably mounted upon the pivot supports or brackets 15*a* and 15*b* and extends forwardly and rearwardly from such pivots. Attached to the forward section of the support framework 23, is a door support 25, which in the preferred embodiment comprises an angle section 25*a* which is securely welded or otherwise secured to the end of the support framework 23, in a position such that it lies or is positioned upon the base 13 essentially directly above or against the edge of the triangular base opposite the apex of such triangle in which the threaded rod is mounted when the door holding end of the framework 23 is pivoted downwardly to its lowest position adjacent the base. The door support 25 is comprised of a base support 26*a* upon which the door rests while being jacked or supported and a side support 26*b* which contacts the side of the door as it rests on the base support 26*a* and serves to align the door straight on the base support 26*a*. In the embodiment illustrated in the figures, the base support 26*a* and the side support 26*b* constitute the two flanges of an angle section 25*a*. Having the wider section of the triangular section underneath the angular door support 25 or 25*a* provides the best stability of the apparatus with respect to undesirable rocking or movement of the door during installation while providing minimum weight with maximum strength of the hanging jack. An opposite end of the rectangular support framework 23 intersects the threaded rod 17 and has an orifice 27 in its rear arm 23*a* to accommodate such rod. See FIG. 5 showing a disassembled apparatus. Such orifice 27 allows the rod 17 to extend through the framework 23 and by means of a movable female threaded member 29 the support framework 23 may be forced downwardly or tilted downwardly at the end of the framework adjacent to the apex of the triangle at the same time lifting the support angle 25 upon which the door is balanced.

The female threaded member 29 has two rod sections 31*a* and 31*b* which extend outwardly from such threaded member. These rod sections 31*a* and 31*b* are bent upwardly at their ends to preferably a common height above the threaded member sufficient so that when the internally threaded member 29 is at its lowest point with the door support angle 25 lifted to its highest point, the tops of the rod sections 31*a* and 31*b* are still higher than the top of the threaded rod 17 upon which the internally threaded fitting 29 is threaded. The tops 35*a* and 35*b* of the two threaded rods 31*a* and 31*b* provide convenient handles which may be easily rotated by placing the foot or sole of the shoe of the workman on them and rotating the foot to adjust the position of the threaded member 29 which thereby adjusts the pivoting of the support framework 23 and therefore the elevation of the door support 25 or door support angle 25*a* above the base 13. Preferably there is also a strengthening bar 33 welded or otherwise secured between the outside portions or arms 23*b* and 23*c* of the support framework 23 generally adjacent to the pivot points of such support framework in order to further add to the rigidity to the support framework.

There is also preferably on each side of the triangular base 13 a narrow rectangular strip 39 which is welded essentially at right angles to the base with more of the strip 39 extending under the triangular base 13 near the apex of the base than near the lateral side along which the door angle support 25 is disposed. See in particular FIGS. 1, 2, 3, 6 and 7. The rectangular strips 39 have two functions. Near the apex of the triangle they effectively lift the apex upwardly slightly to provide room or clearance under the base 13 for the head 17*b* of the threaded rod or bolt 17, see, for example, FIG. 7, and at the same time along their length provide for closer or narrower contact with the floor of the building preventing sliding of the base upon the floor while having sufficient width or lateral extent not to seriously mar the floor. This can be seen best in FIGS. 6 and 7 which are angled upper and lower isometric views, respectively, of the base 13.

Figure 2:
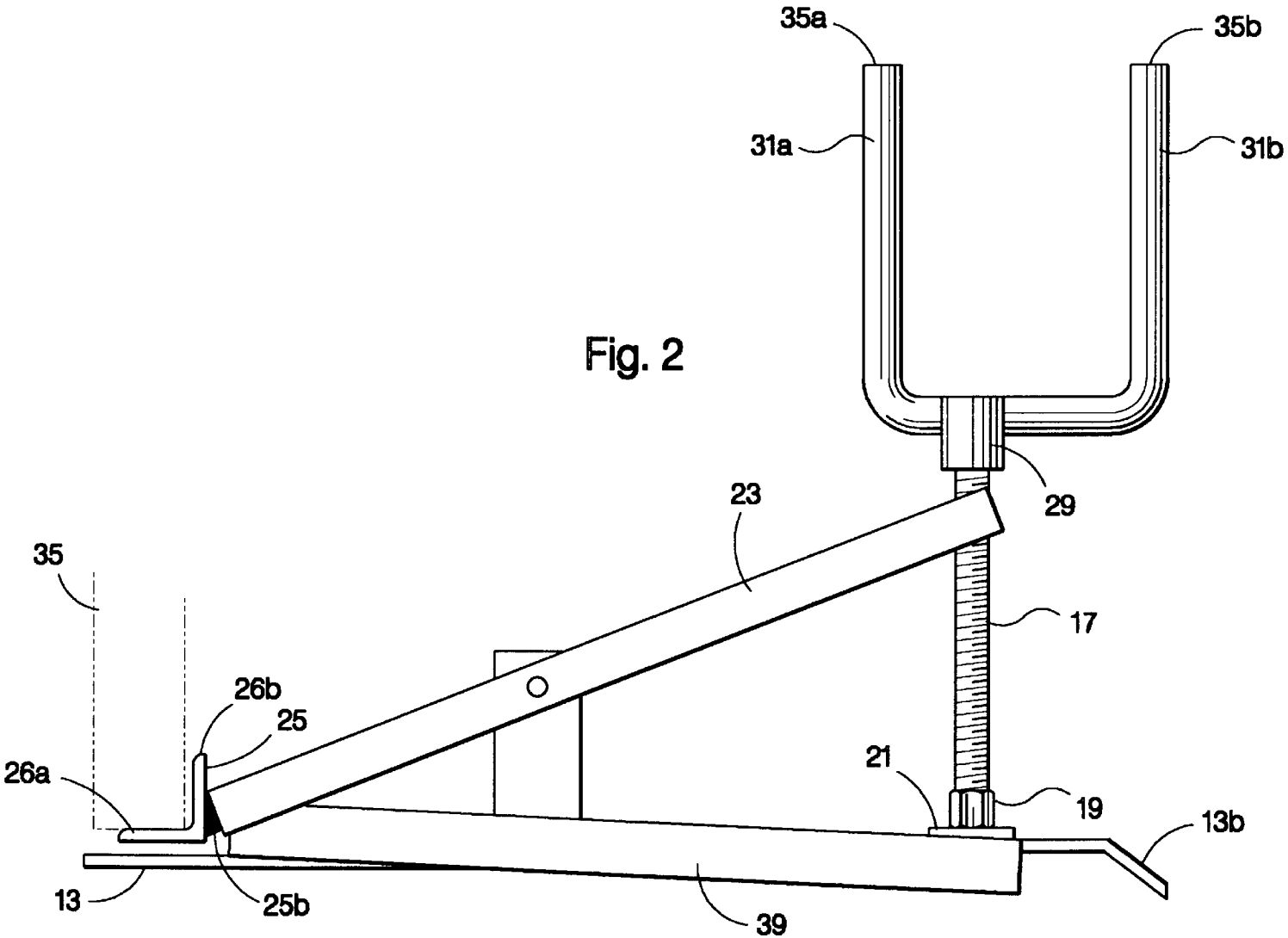
FIG. 2 is a side elevation of the door-hanging apparatus of the invention supporting a door for positioning in a door frame with the lift portion of the apparatus in lowered position.

As will be recognized, FIG. 2 is a side view or elevation of the apparatus of the invention with the pivoted support framework 23 pivoted down to allow the door support 25 to receive the bottom of a door 35 partially shown in broken lines upon the door support 25. It will be noted that the door support 25 is secured by appropriate weld material 25*b* extending between the rear portion of the door support 25 and the ends of the side members 23*b* and 23*c* of the framework 23 to position the door support at an angle upon the side members 23*b* and 23*c* such that in its lower position the support surface 26*a* is essentially parallel or closely adjacent to the upper surface of the base 13. As the framework 23 is then pivoted upwardly, the angle of the door support 25 shifts so that even if the side of the door was not originally adjacent the side support 26*b* it will tend to shift upon the bottom support 26*a* so that the side of the door is shifted against the surface of the side support 26*b* to ensure the alignment of the door on the door support 26*a*.

Figure 3:
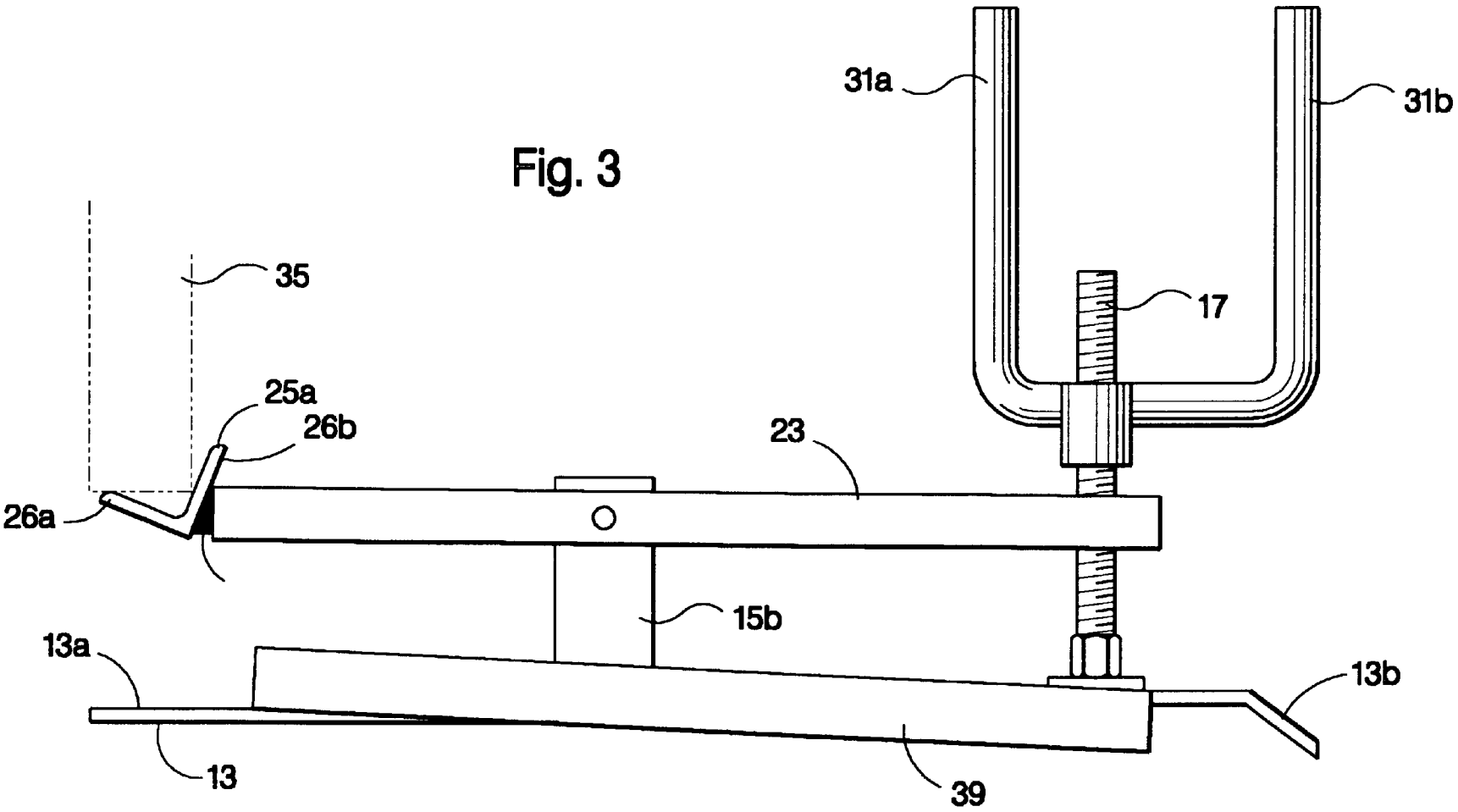
FIG. 3 is a side view of the apparatus of the invention with the lift portion of the apparatus in raised position.

FIG. 3 is a side elevation similar to FIG. 2 showing the pivoted framework 23 pivoted upwardly supporting the door. It can be seen how the position of the door 35, shown in broken lines, tends to be shifted across the base support surface 26*a* toward or against the side support 26*b* as the angle of the door support 25 changes with lifting or pivoting of the support framework 23.

In operation of the device, the base of the door-hanging jack 11 is placed in the position where it is desired to hang the door. A door shown in FIG. 2 from the side partly broken away in broken lines as section 35 is placed on the door support angle 25 or more particularly the base support 26*b*. Since the door jack is sufficiently wide so it is clearly parallel to the floor surface and the door or base support 26*a* of the angle 25*a* is mounted exactly parallel to the wide section of the base, the door will be held exactly parallel with the floor. The workman will normally life the door in his hands and will place it securely on the door support angle 25*a* or base support 26*a* of such angle where it will be securely held in a non-tipping position. The rod or handle sections 31*a* or 31*b* may then be rotated by placing the foot of the user upon the top 35*a* or 35*b* of each rod or handle and rotating such rods about the threaded rod 17 rotating the female threaded fastening 19 and adjusting the position of the support framework 23 and the angle support 25 until the door is lifted to the proper height at which point the workman's task of attaching the door to the framework can be easily carried out. As pointed out above, the door will in the meantime be held perfectly parallel to the floor with the apparatus effectively aligning the door perfectly in the position which it is to assume when fully mounted in the door frame.

Figure 4:
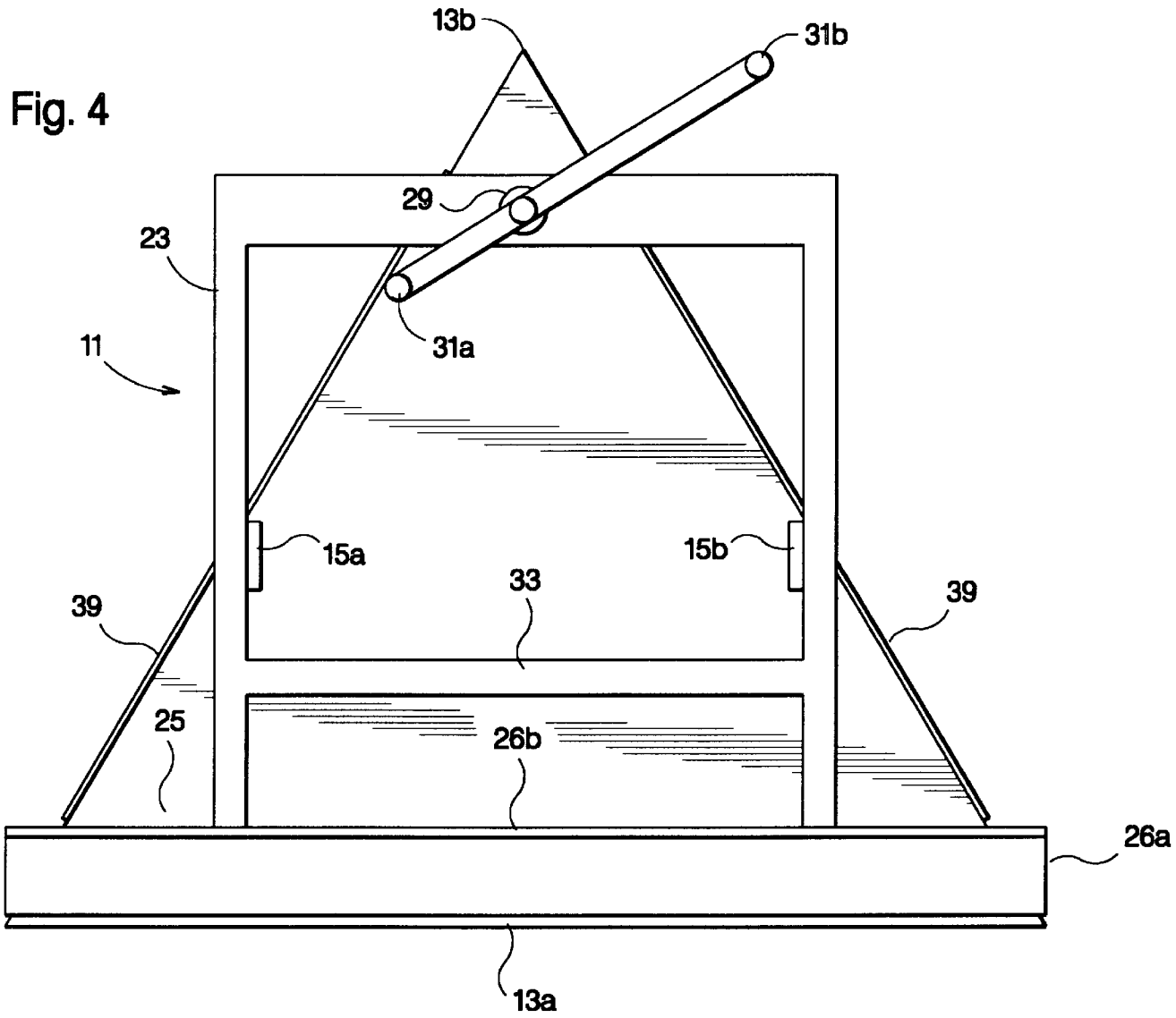
FIG. 4 is a plan view of the door-hanger apparatus shown in FIGS. 1, 2 and 3.
Figure 6:
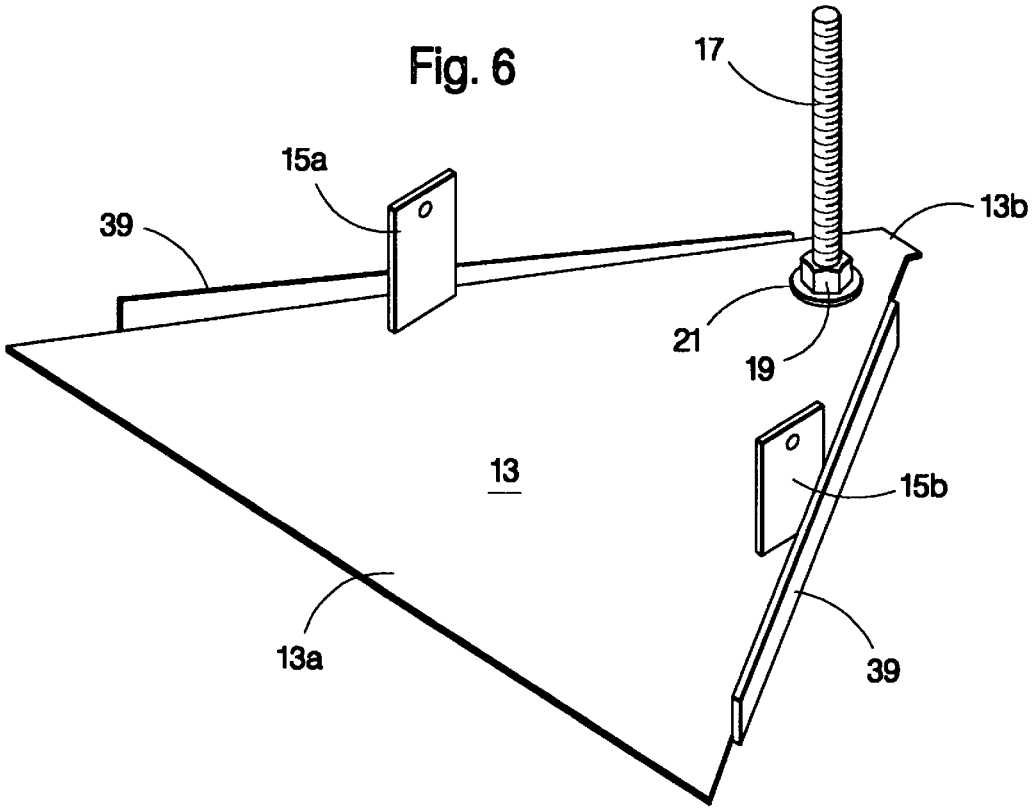
FIG. 6 is a top isometric view of the top of the preferred base of the invention.
Figure 7:
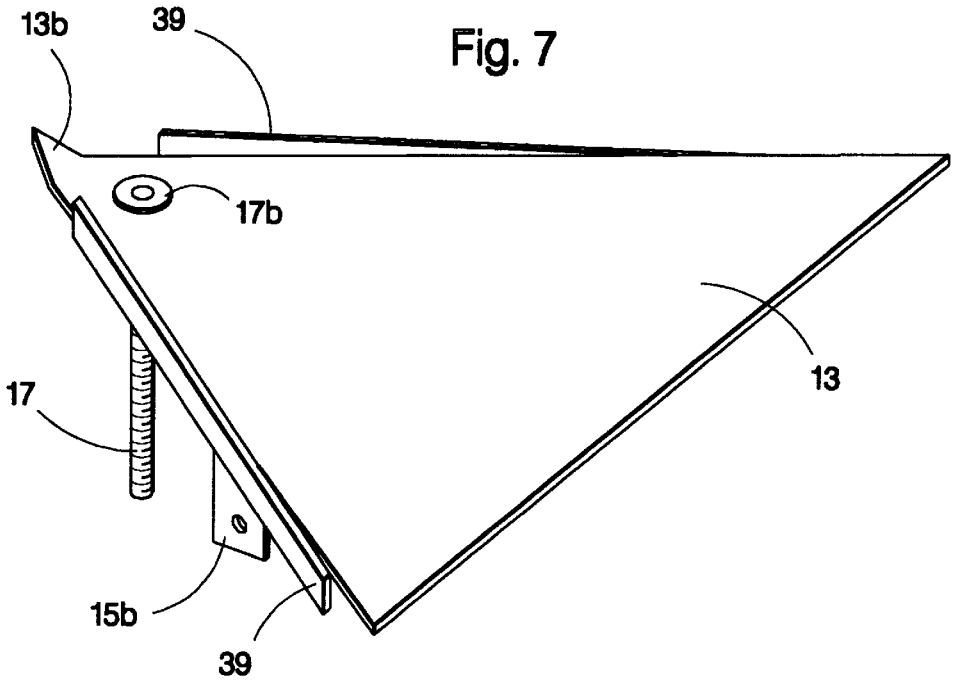
FIG. 7 is a bottom isometric view of the bottom of the preferred base of the invention.

FIG. 4 is a plan view of the door-hanging apparatus of the invention generally showing the triangular base which could, however, be replaced by a broadly arcuate base with a segmented side along the door support section which configuration also would reduce the general weight of the apparatus. However the triangular base is generally easier to make and near the ultimate in regular sectional unitary bases so far as reduced weight is concerned. In addition, as shown in FIGS. 6 and 7, the base 13 is preferably provided with two low metal sections 39 along the sides of the triangle which preferably gradually increase in height on the bottom towards the rear of the apparatus as shown to slightly lift the apparatus at the apex of the triangle to accommodate the head 17*b* of the bolt or thread member 17 at or close to the apex of the triangle and also to provide, particularly at the other end of or at the opposed lateral side of the triangle, linear projections from the bottom of the base which aid in preventing the base from sliding over the floor. The triangular shape of the base 13 provides a better configuration for the economical addition of the sections 39. The path of the tops 35*a* and 35*b* of the rod sections 31*a* and 31*b* when rotated by foot (or hand) contact will in the plan view of FIG. 4 describe imaginary concentric circles, not shown.

As best seen in the side elevational views of FIGS. 2 and 3 the apex 13*b* of the triangular base 13 opposite the broad section 13*a* underlying the door support angle 25 is turned downwardly to match the lower rear edge of the rectangular strip 39 and aid in both supporting the rear of the base above the bolt or head 17*b* of the bolt or threaded member 17 underneath and generally stabilizing the base on the floor.

FIG. 5 is an assembly view of the invention illustrating the triangular base 13 and generally rectangular support frame 23 by themselves or disassembled from each other and thus illustrating or showing the major parts broken away from each other. The parts are identified with the same reference numerals as in the preceding views.

FIG. 6 as described earlier is an isometric view of the top of the triangular base 13 showing the threaded bolt or stud 17 at one apex, the two pivot members 15*a* and 15*b* and the side members 39 along the side edges. The working edge 13*a* provides the surface which directly supports the lift or door support member 25 when in its lower position as shown in FIG. 2 and balances the weight of the door when in a raised position as shown in FIG. 3.

FIG. 7 is a view as indicated above of the bottom of the apparatus illustrating the side members 39 and the bolt head 17*b* shown here as a round member disposed upon or actually under in operating position the surface of the base.

Figure 8:
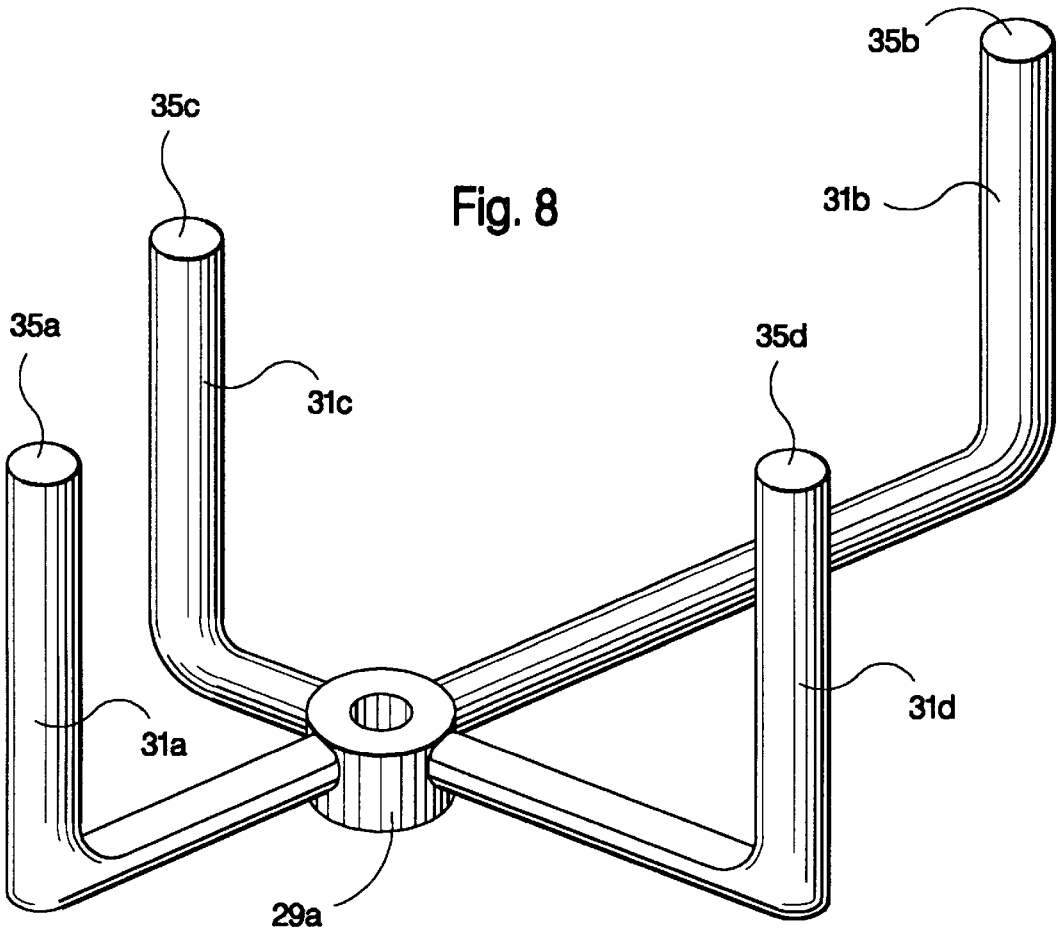
FIG. 8 is an isometric view of a further embodiment of a foot operatable threaded adjustment handle for the door hanging apparatus of the invention.

FIG. 8 is an isometric view of a female threaded member 29*a* having four separate turning or adjustment handles 31*a*, 31*b*, 31*c* and 31*d* attached to it having flat tops 35*a*, 35*b*, 35*c* and 35*d* for contact with the foot or shoe sole of the user. The four separate handles 35 each of which has a different length lever arm with respect to the female threaded member 29*a* provides increased variability in foot adjustment speed and/or force applied to the pivoting framework 23 at the door support section at the opposite end.

Figure 9:
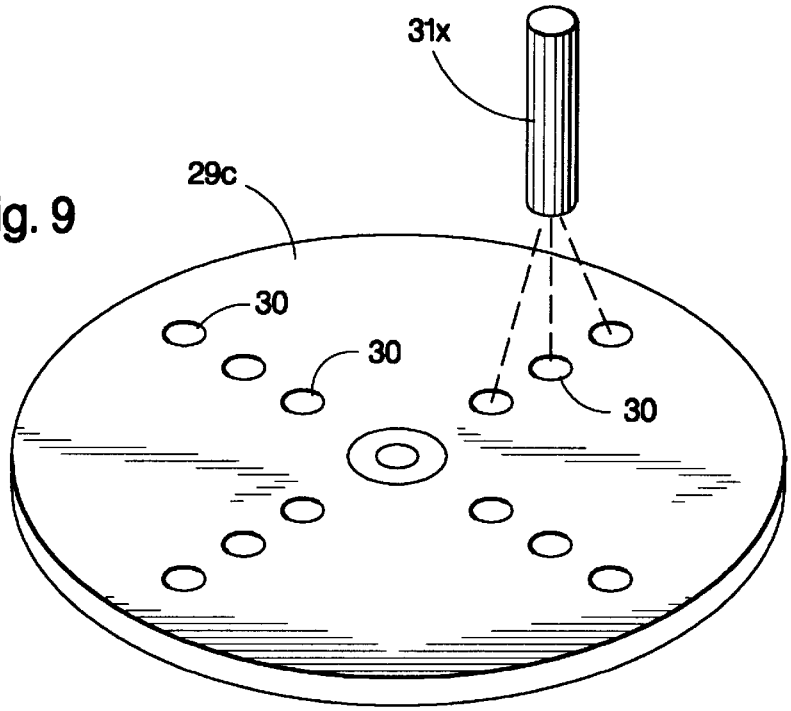
FIG. 9 is an isometric view of a still further foot operatable adjustment handle for the door-hanging apparatus of the invention.

FIG. 9 is an isometric view of a generally round handle or threaded member 29*c* having individual handle positions 30 which also provides variable or adjustable leverage for rotating the threaded fitting 29 not shown.

Figure 10:
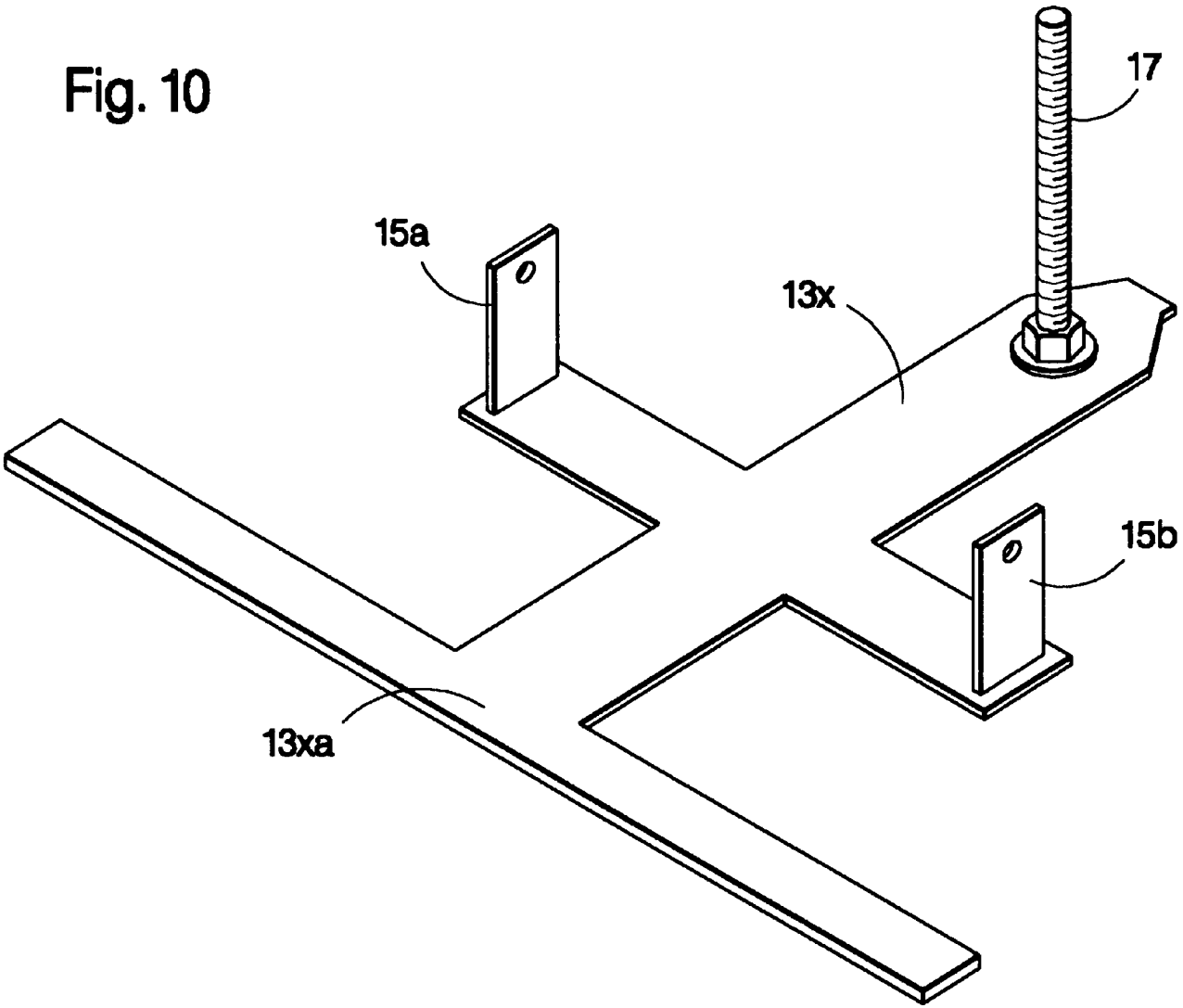
FIG. 10 is a top isometric view of an alternative base form for the door-hanging apparatus of the invention.

FIG. 10 shows a still further embodiment of the invention in which the base 13*x* is made in a semi-cross or double-cross or cruciform configuration. This minimizes the weight of the base, but also tends not to be as sturdy unless the material from which it is made is of a thicker section, in which case the weight may be increased overall. The sections along the edge of the triangular base which lift the apex 13*b* of the triangle shown in other figures from the floor to accommodate the head of the threaded rod 17 and provide better contact with the floor may also be used along the edges of the double-cross of FIG. 10 to add rigidity to the cruciform configurations of FIG. 10 base by providing sections along the edge thereof, not shown, and in this manner by stiffening the structure enable a somewhat thinner section to be used without any danger of bending or warping caused by the weights of the heavy doors which are supported on the angle 25 shown in other figures.

Figure 11:
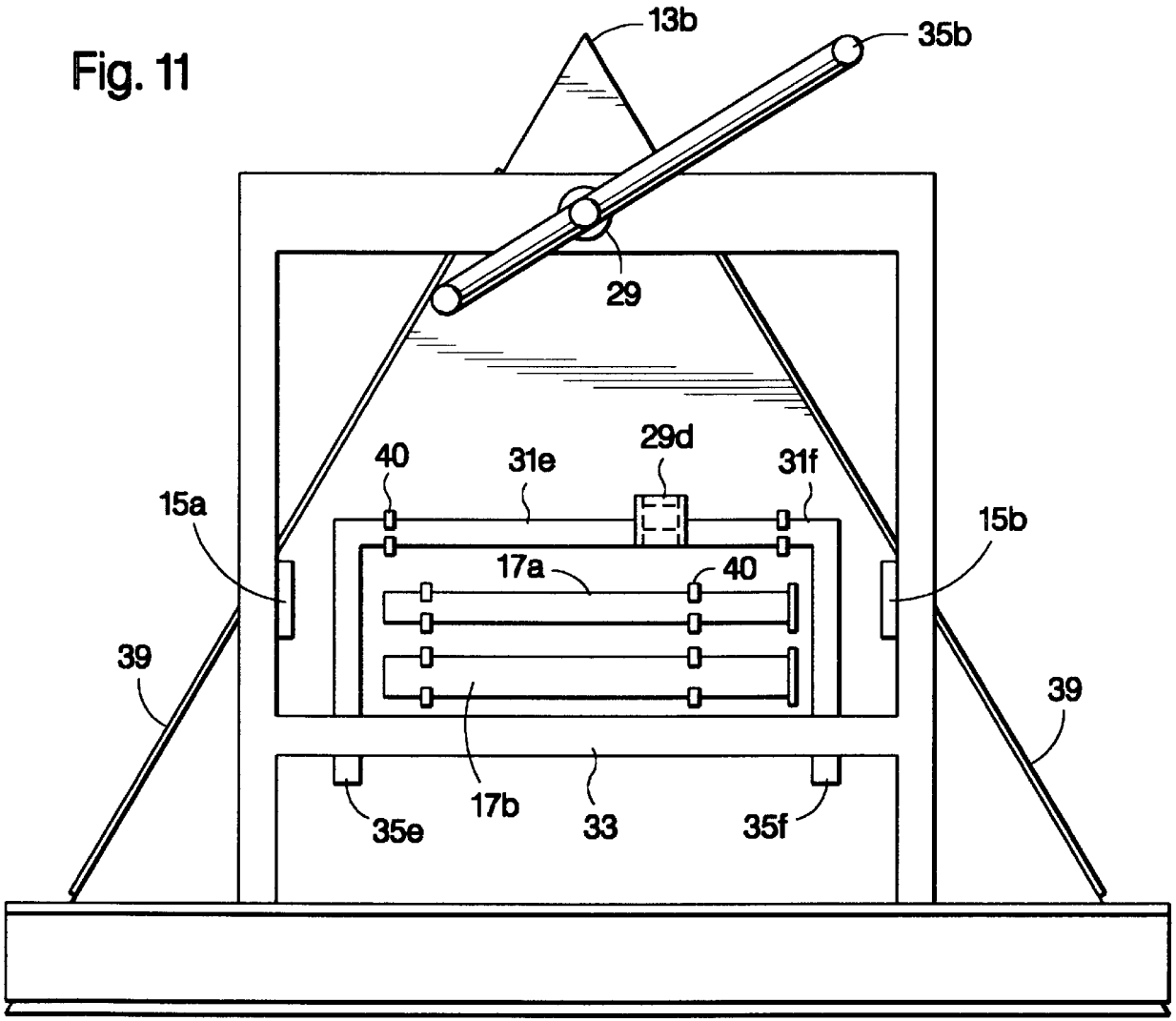
FIG. 11 is a plan view of an alternative form of the invention provided with alternative threaded members plus an adjustable handle for use on the alternative members.

FIG. 11 is a plan or top view of a further embodiment of the invention having a substitute handle or threaded member 29*d* with preferably an adjustable center screw thread plus two additional threaded bolts 17*a* and 17*b* of different sizes and screw threads to make the device more adjustable with respect to speed of operation. The provision of these additional members removably secured to the base 13 by any suitable catch means 40 provides desirable adjustability of the speed and range of movement when using the apparatus of the invention.

It has been found that the width of the side of the triangular base adjacent to the door support base 26*a*, as well as the door support member 25 itself, should be at least one foot, or twelve-inches, wide and more preferably at least fourteen-inches wide and more preferably still about sixteen-inches wide. Preferably it would not be more than eighteen-inches wide or at most twenty-inch wide, since then the structure becomes too heavy for reasonable transportation and it has been found that the extra width in addition does not add significant additional stability. The width of the door holding support therefore is preferably from fourteen to eighteen inches in width, and less preferably, about twelve to twenty inches in width, with a preferable width of about sixteen inches, plus or minus one inch. The materials are preferably one-sixteenth inch plate, or at most, about one-eighth inch plate, which may be conveniently welded together. While the apparatus could be formed from a strong plastic composition, the thicknesses which would be required to give such construction sufficient rigidity for precise positioning, would tend to mitigate against use of plastic materials.

As indicated above, the applicant has found that the described door jack is very effective in providing a secure and effective jack for placement of doors in door frames in order to adjust such doors during their installation.

Unlike previous jacks, the jack of the invention supports the door in exactly the position it is to be mounted without instability or tipping and maintains it parallel both to the floor and to the door frame during mounting.

While the present invention has been described at some length and with some particularity with respect to several described embodiments, as well as the best mode now known to the applicant, it is not intended that the applicant's invention should be limited to any such particulars or embodiments or to any particular embodiment, but is to be construed broadly with reference to the appended claims so as to provide the broadest possible interpretation of such claims in view of the prior art and therefore to effectively encompass the intended scope of the invention.

I claim:

1. A door-hanging jack having a sturdy and stable base comprising:

(a) a bottom plate wider at one end and narrower at the other end and having a length along the sides of between twelve and twenty inches with two pivot points along opposite sides of and above said plate upon upstanding brackets between which pivot points a support frame is pivoted, (b) such support frame being comprised of a rectangular structural framework supported about one third of the way toward one end upon the upstanding brackets, (c) a door support member having a door supporting lower section and a side alignment section attached to an end of the rectangular support frame disposed over the wider end of the bottom plate, (d) a threaded rod member extending from the narrower end of the base opposite to the wider end over which the door support member is disposed through an orifice in the end of the rectangular member over the narrower end of the bottom plate, and (e) wherein the bottom plate is generally cruciform in configuration when viewed from the top.

2. A door-hanging jack in accordance with claim 1 in which the bottom plate is generally cruciform in configuration.

3. A door-hanging jack in accordance with claim 1 wherein the bottom plate is triangular in configuration.

4. A door-hanging jack having a sturdy and stable base comprising:

(a) a bottom plate wider at one end and narrower at the other end and having a length along the sides of between 12 and 20 inches with two pivot points along opposite sides of and above said plate upon upstanding brackets between which pivot points a support frame is pivoted, (b) such support frame being comprised of a rectangular structural framework supported about one third of the way toward one end of said frame upon the upstanding brackets, (c) a door support member having a laterally extended door supporting lower section and a laterally extended side alignment section attached to an end of the rectangular support frame disposed over the wider end of the bottom plate, (d) a threaded rod member extending from the narrower end of the base opposite to the wider end over which the door support member is disposed through an orifice in the narrower end of the rectangular member, and (e) wherein the bottom plate is horizontally extended into a triangular configuration.

5. A door-hanging jack in accordance with claim 4 wherein the threaded rod member has a female threaded member upon it having two handles with upstanding ends at different radial distances from the female threaded member which handles may be contacted alternatively by the feet of a workman in order to provide differential speeds for movement of the door-support member.

6. A door-hanging jack in accordance with claim 5 wherein there are two additional handles for a total of four handles on the female threaded member at different radial distances from the threaded member.

7. A door-hanging jack in accordance with claim 5 additionally comprising:

(f) rectangular support members disposed along the sides of the triangular base and extending at least partially below the base.

8. A door-hanging jack in accordance with claim 4 wherein the laterally extended door-support member is generally aligned with and directly over the edge of the triangular base.

9. A door-hanging jack in accordance with claim 8 wherein the length of the laterally extended door support member is substantially coextensive with the length of one side of the horizontally extended triangularly configured bottom plate over which it is positioned.

10. A door-hanging jack in accordance with claim 5 additionally comprising:

(f) at least one extra threaded rod member having a different threaded arrangement removably secured to the door-hanging jack for interchange with the normal threaded rod member plus a female threaded fitting with handles for interengagement with said threaded rod section.

11. A door-hanging jack in accordance with claim 4 additionally comprising a substantially circular female threaded member having at least several positions for receipt of adjustable position handle adapted for engagement on the end with foot pressure.

12. A door-hanging lack in accordance with claim 5 wherein there are linearly extending structural sections secured to two sides of the bottom plate in a vertical orientation and extending at least partially below the bottom to serve as feet and establish the clearance of such bottom plate from a support surface.

13. A door-hanging lack in accordance with claim 12 wherein the structural sections are generally rectangular in configuration and overlap the sides of the base for different distances at different locations.

14. A sturdy and stable door-hanging jack comprising:

(a) a base plate having a generally triangular configuration with two raised brackets adjacent opposite sides of the triangularly configured base plate and opposite each other and approximately two thirds of the way from the apex of the triangular configuration at which the opposite sides adjacent the raised brackets meet, (b) a support frame comprised of a generally rectangular structural framework pivotally supported between the two raised brackets, (c) a linearly extended door support member having a door supporting lower section and a side alignment section attached to the end of the support frame closest to the pivot point of said frame, (d) a threaded rod member extending from the apex of the base plate at which apex the sides of the base plate to which the raised brackets are adjacent and opposite to the door support member through an orifice in the opposite end of the rectangular frame and from the door support member, and (e) a female threaded member threaded upon the threaded rod member above the rectangular frame.

15. A door-hanging jack in accordance with claim 14 wherein the threaded rod member has a female threaded member upon it having at least two handles with upstanding ends at different radial distances from the female threaded member.

* * * * *